US006821134B2

(12) United States Patent
Chen

(10) Patent No.: US 6,821,134 B2
(45) Date of Patent: Nov. 23, 2004

(54) ROTATABLE PLUG APPLIED IN POWER SUPPLY APPARATUS

(75) Inventor: Chen-Chun Chen, Taoyuan Shien (TW)

(73) Assignee: Delta Electronics Inc., Taoyuan Shien (TW)

( * ) Notice: Subject to any disclaimer, the term of this patent is extended or adjusted under 35 U.S.C. 154(b) by 0 days.

(21) Appl. No.: 10/044,605

(22) Filed: Jan. 10, 2002

(65) Prior Publication Data

US 2003/0045143 A1 Mar. 6, 2003

(30) Foreign Application Priority Data

Sep. 4, 2001 (TW) ..... 90215152 U

(51) Int. Cl.[7] ..... H01R 13/44
(52) U.S. Cl. ..... 439/131; 439/11
(58) Field of Search ..... 439/131, 11–13, 439/20–22, 27, 29, 18, 172, 174, 640, 31; 320/111, 113, 107; 361/683, 686

(56) References Cited

U.S. PATENT DOCUMENTS

| | | | | |
|---|---|---|---|---|
| 5,352,122 A | * | 10/1994 | Speyer et al. | 439/13 |
| 6,093,028 A | * | 7/2000 | Yang | 439/13 |
| 6,275,002 B1 | * | 8/2001 | Chen | 320/111 |
| 6,364,716 B1 | * | 4/2002 | Seo | 439/640 |
| 6,398,566 B1 | * | 6/2002 | Chen | 439/131 |
| 6,454,578 B1 | * | 9/2002 | Yao | 439/131 |
| 6,488,510 B2 | * | 12/2002 | Li | 439/13 |

* cited by examiner

*Primary Examiner*—Alex Gilman

(57) ABSTRACT

A rotatable plug for connecting to an electronic receptacle is disclosed. The rotatable plug applied in an electronic equipment includes a plug for plugging into the electronic receptacle and fixing and electrically connecting to at least two conductive wires, a rotary case for disposing the plug, a top cover having a circle opening and an annular frame, wherein the annular frame is disposed around the opening for accommodating the rotary case therein to rotate and the plug is carried to rotate when the rotary case is rotated, and a restricting mechanism for limiting the rotary case to rotate in a particular rotating range.

19 Claims, 9 Drawing Sheets

ROTATABLE PLUG APPLIED IN POWER SUPPLY APPARATUS

FIELD OF THE INVENTION

The present invention relates to a rotatable plug applied in an electronic equipment, and more particularly to a foldable and rotatable plug applied in a power supply apparatus.

BACKGROUND OF THE INVENTION

The conventional plug used for electrically connected to the electrical power is unable to be rotated to change the direction of the blade. However, the direction of the slot in the socket is fixed. Thus, the plug usually has to accommodate to the direction of the slot in the socket for achieving the electrical connection. Hence, when the plug of an adapter or a battery charger is plugged into a socket, the adjacent socket is usually blocked owing to its large volume. Therefore, it causes inconvenience for the user.

Generally, for a rotatable plug, a circle conductive wire is employed to achieve the rotation of the plug. However, when the plug is rotated, the bad conductive contact can happen. Hence, for a good conductive contact, the circle conductive wire will be disposed very close to the blade of the plug. Thus, it will cause unsafety issue. In addition, the typical rotatable plug includes many components. Thus, the assembly procedure is complicated beside the materials are cost.

Therefore, the purpose of the present invention is to develop rotatable plug to deal with the above situations encountered in the prior art.

SUMMARY OF THE INVENTION

It is therefore an object of the present invention to provide a rotatable plug for optionally changing the direction of the blade of the plug to efficiently overcome the space limitation problem.

It is therefore another object of the present invention to provide a rotatable plug for directly use with the typical conductive wire.

It is therefore an additional object of the present invention to provide a rotatable plug for avoiding the bad conductive contact and unsafety problems of the prior art.

It is therefore an additional object of the present invention to provide a rotatable plug for simplifying the assembly procedure and reducing the material cost.

According to an aspect of the present invention, there is provided a rotatable plug for connecting to an electronic receptacle. The rotatable plug applied in an electronic equipment includes a plug for plugging into the electronic receptacle and fixing and electrically connecting to at least two conductive wires, a rotary case for disposing the plug, a top cover having a circle opening and an annular frame, wherein the annular frame is disposed around the opening for accommodating the rotary case therein to rotate and the plug is carried to rotate when the rotary case is rotated, and a restricting mechanism for limiting the rotary case to rotate in a particular rotating range.

For example, the electronic equipment is an adapter or a battery charger.

For example, the plug is a fixed plug or a foldable plug.

Preferably, the foldable plug includes a transverse rod having a first and a second grooves and having two ends for pivotally connected to the rotary case, at least two blades for plugging into the electronic receptacle, and at least two conductive terminals fixed and electrically connected to the at least two conductive wires respectively, wherein each blade and each conductive terminal are disposed at two opposite sides of the transverse rod to form a particular angle. Each blade and each conductive terminal are preferably integrally formed. The transverse rod, the first groove and the second groove are preferably integrally formed.

Preferably, the rotary case includes a concave storage base on a front surface having an opening disposed at one end of the concave storage base for disposing the plug therein and used for receiving the at least two blades therein when the plug is folded, and an elastic engaging element having a first end fixed and connected to a back of the rotary case and a second end for engaging the transverse rod of the plug to slide between the first and second grooves of the transverse rod. The rotary case, the concave storage base, the elastic engaging element and the opening are preferably integrally formed.

Preferably, the circle opening has a diameter smaller than an inside diameter of the annular frame and the rotary case has a diameter smaller than the inside diameter of the annular frame.

Preferably, the rotary case includes an annular groove surrounded a circumferential surface of the rotary case and the annular frame of the top cover has a protruding element at a relative position of the annular groove for engaging to the annular groove.

For example, the protruding element can be an annular protrusion. Preferably, the annular groove includes a plurality of position points and the annular protrusion includes a plurality of position units for engaging with the plural position points for positioning a direction of the plug. Preferably, each position point is a concave point and each position unit is an elastic jut, wherein the elastic juts have a relative position with the concave points for engaging with the elastic juts respectively.

Preferably, the restricting mechanism includes a first protrusion disposed on a circumferential surface of the rotary case and between two the position points, and a second protrusion disposed on an inside wall of the annular frame and between the two elastic juts, whereby when the rotary case rotates in a first direction till the first protrusion is against the second protrusion, a rotation of the rotary case in the first direction is limited. The top cover, the annular frame, the protruding element and the second protrusion are preferably integrally formed. The rotary case, the annular groove, the plural concave points and the first protrusion are preferably integrally formed.

Preferably, the rotary case has a particular thickness and the annular frame further comprises a stopper for allowing the rotary case to rotate in the annular frame. The annular groove preferably includes a plurality of position points for positioning a direction of the plug. Preferably, each position point is a concave point and each the position unit is an elastic jut, wherein the elastic juts have a relative position with the concave points for engaging with the elastic juts respectively.

Preferably, the restricting mechanism includes a first protrusion disposed on a circumferential surface of the rotary case, and a second protrusion disposed on an inside wall of the annular frame, whereby when the rotary case rotates in a first direction till the first protrusion is against the second protrusion, a rotation of the rotary case in the first direction is limited. The top cover, the annular frame and the second protrusion are preferably integrally formed. The rotary case and the first protrusion are preferably integrally formed.

According to another aspect of the present invention, there is provided a rotatable plug for connecting to an electronic receptacle. The rotatable plug applied in an electronic equipment includes a plug for plugging into the electronic receptacle and fixing and electrically connecting to at least two conductive wires, a rotary case for disposing the plug, and a top cover having a circle opening and an annular frame, wherein the annular frame is disposed around the opening for accommodating the rotary case therein to rotate and the plug is carried to rotate when the rotary case is rotated.

Preferably, the rotatable plug further includes a restricting mechanism for limiting the rotary case to rotate in a particular rotating range. The restricting mechanism includes a first protrusion disposed on a circumferential surface of the rotary case, and a second protrusion disposed on an inside wall of the annular frame, whereby when the rotary case rotates in a first direction till the first protrusion is against the second protrusion, a rotation of the rotary case in the first direction is limited.

The present invention may best be understood through the following description with reference to the accompanying drawings, in which:

DETAILED DESCRIPTION OF THE PREFERRED EMBODIMENTS

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 1:
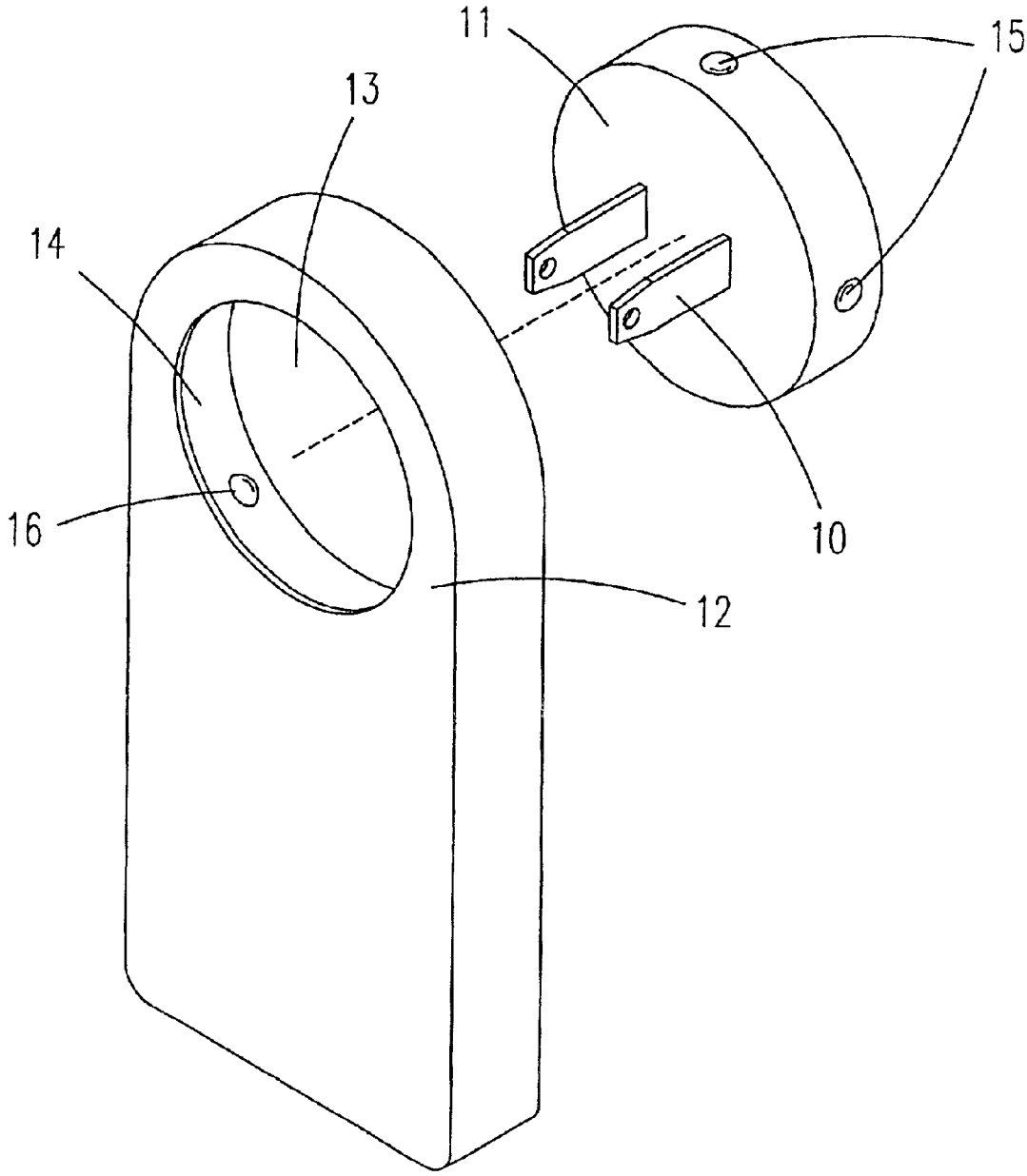
FIG. 1 is a three-dimensional decomposed diagram illustrating a preferred embodiment of a rotatable plug according to the present invention.

FIG. 1 is a three-dimensional decomposed diagram illustrating a preferred embodiment of a rotatable plug according to the present invention. As shown in FIG. 1, the rotatable plug includes a plug 10, a rotary case 11, a top cover 12, and a restricting mechanism (not shown). The plug 10 has one end for plugging into an electronic receptacle such as a socket and the other end for fixing and electrically connected to two conductive wires (not shown). The rotary case 11 has an opening for disposing the plug 10 therein. There are a circle opening 13 and an annular frame 14 at one end of the top cover 12. The annular frame 14 is disposed on the back of the top cover 12 and surrounds the circle opening 13 as shown in FIG. 1. When the rotary case 11 is put into the circle opening 13 and surrounded by the annular frame 14, the rotary case 11 can rotate and further carry the plug 10 to rotate for change the direction of the plug 10. Moreover, the restricting mechanism is used for limiting the rotary case 11 in a particular range for preventing the conductive wires from intertwining with when the rotary case 11 is rotated. The maximum rotation range of the rotary case 11 is 270 degree.

Figure 2:
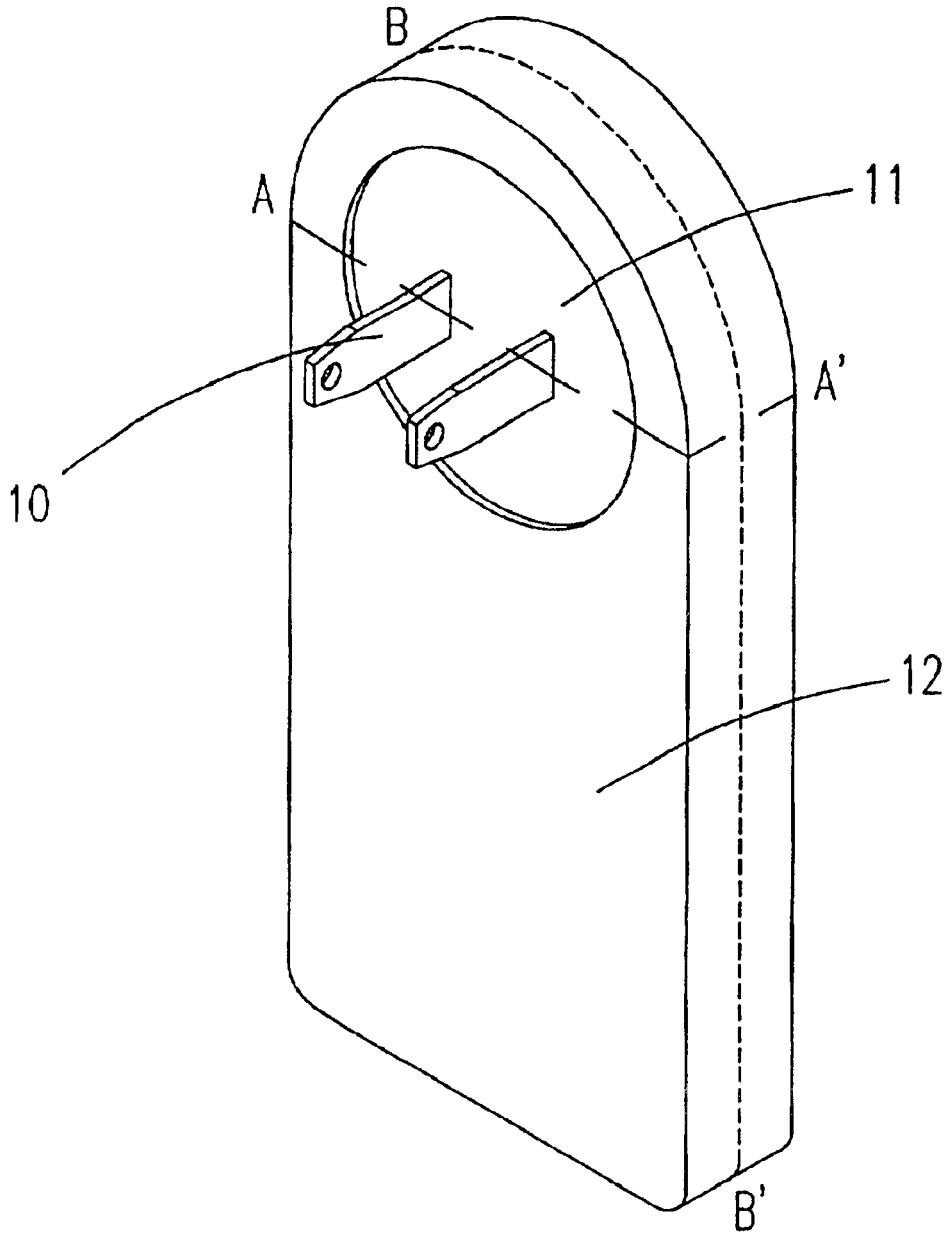
FIG. 2 is an assembly diagram illustrating the rotatable plug in FIG. 1.
Figure 3:
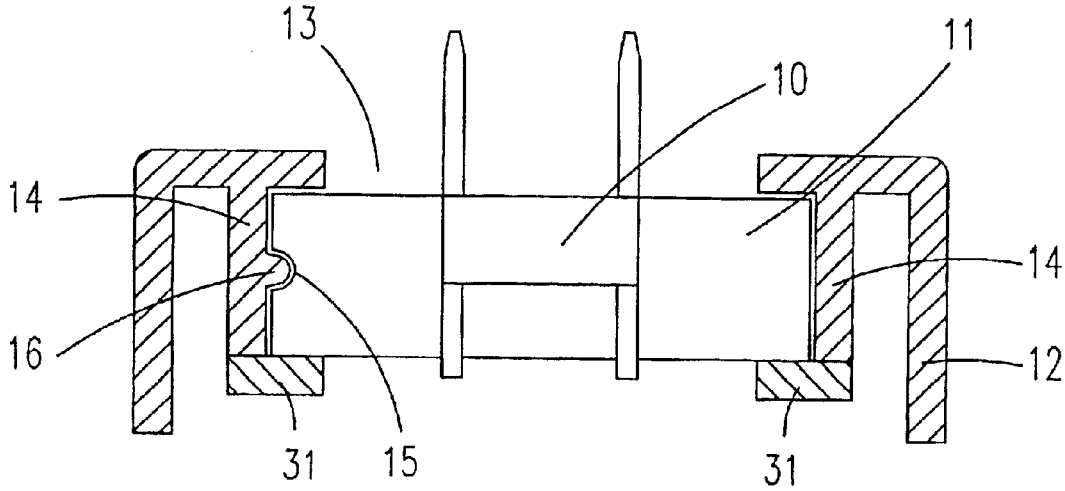
FIG. 3 is an A–A' line cross-sectional diagram illustrating the rotatable plug in FIG. 2.

FIG. 2 is an assembly diagram illustrating the rotatable plug in FIG. 1. FIG. 3 is an A–A' line cross-sectional diagram illustrating the rotatable plug in FIG. 2. As shown in FIG. 3, the diameter of the circle opening 13 of the top cover 12 is smaller than the inside diameter of the annular frame 14. Furthermore, the diameter of the rotary case 11 is smaller than the inside diameter of the annular frame 14. Thus, when the rotary case 11 is disposed into the circle opening 13 from the back of the top cover 12, the rotary case 11 will not fall out from the front of the top cover 12. Moreover, the thickness of the rotary case 11 is similar to that of the annular frame 14 as shown in FIG. 3. When the rotary case 11 is fitted into the circle opening 13, a stopper 3 1 on the back of the top cover 12 will enclose the rotary case 11 inside the circle opening 13 and allow the rotary case 11 to rotate in this space.

Figure 4:
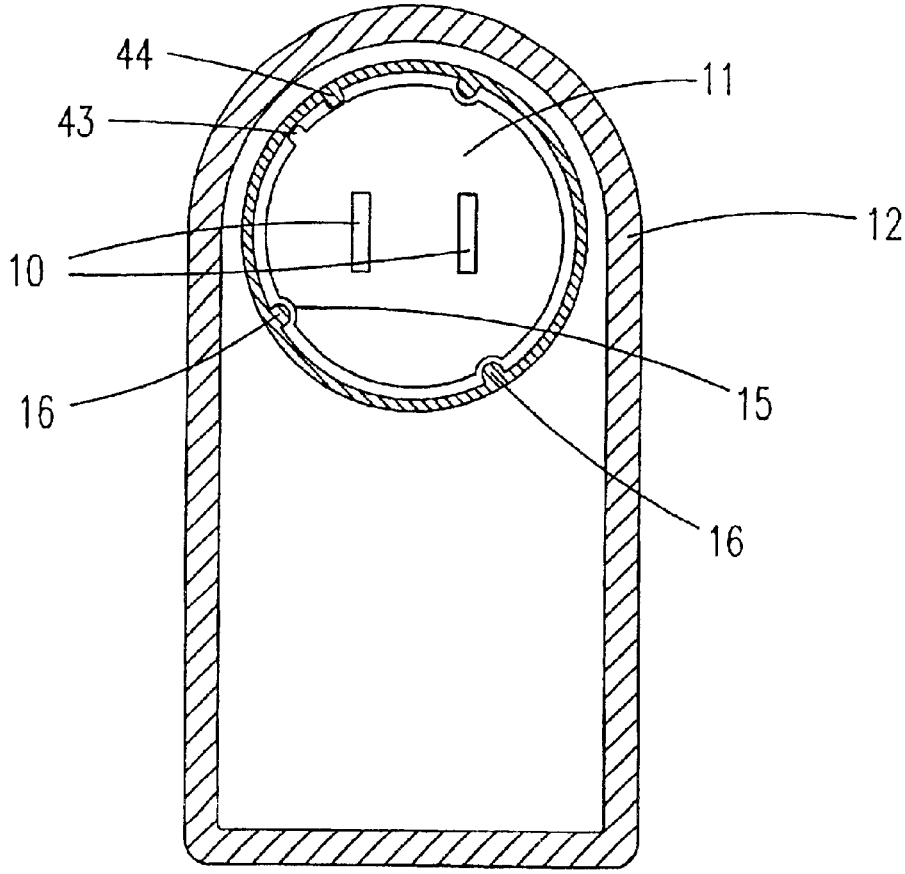
FIG. 4 is a B–B' line cross-sectional diagram illustrating the rotatable plug in FIG. 2.

FIG. 4 is a B–B' cross-sectional diagram illustrating the rotatable plug in FIG. 2. As shown in FIG. 4, the rotary case 11 has three position points, i.e. three concave points 15, on the circumferential surface for positioning the direction of the plug 10. At the same time, the annular frame 14 has three elastic juts 16 which are located at a relative position with the three concave points, respectively, on the inside wall. Thus, when the rotary case 11 rotates to a particular range, each elastic jut 16 will engage with the corresponded concave point 15 for achieving the position effect. The relative position of the concave points and the elastic juts and the engaging condition thereof are shown in FIGS. 1 and 3.

In addition, the restricting mechanism includes a first protrusion 43 and a second protrusion 44. The first protrusion 43 is disposed on the circumferential surface of the rotary case 11 and between two concave points 15, while the second protrusion 44 is disposed on the inside wall of the annular frame 14 and between two elastic juts 16. Thus, when the rotary case 11 is rotated in a first direction till the first protrusion 43 is against the second protrusion 44, the rotary case 11 cannot be rotated toward the first direction anymore. Therefore, the restricting mechanism can prevent the conductive wires fixed on the plug 10 from intertwining with each other because the rotation of the rotary case 11.

FIG. 4 is an assembly diagram illustrating the combination of the first connector and the second connector according to the present invention. As shown in FIG. 4, when the terminal bases are combined with the slots 42 and the conductive pins 321 are contacted with the conductive terminals 421, the first connector 3 and the second connector 4 are combined together by buckling the elastic buckling element 33 with the protruding element 43.

Figure 5:
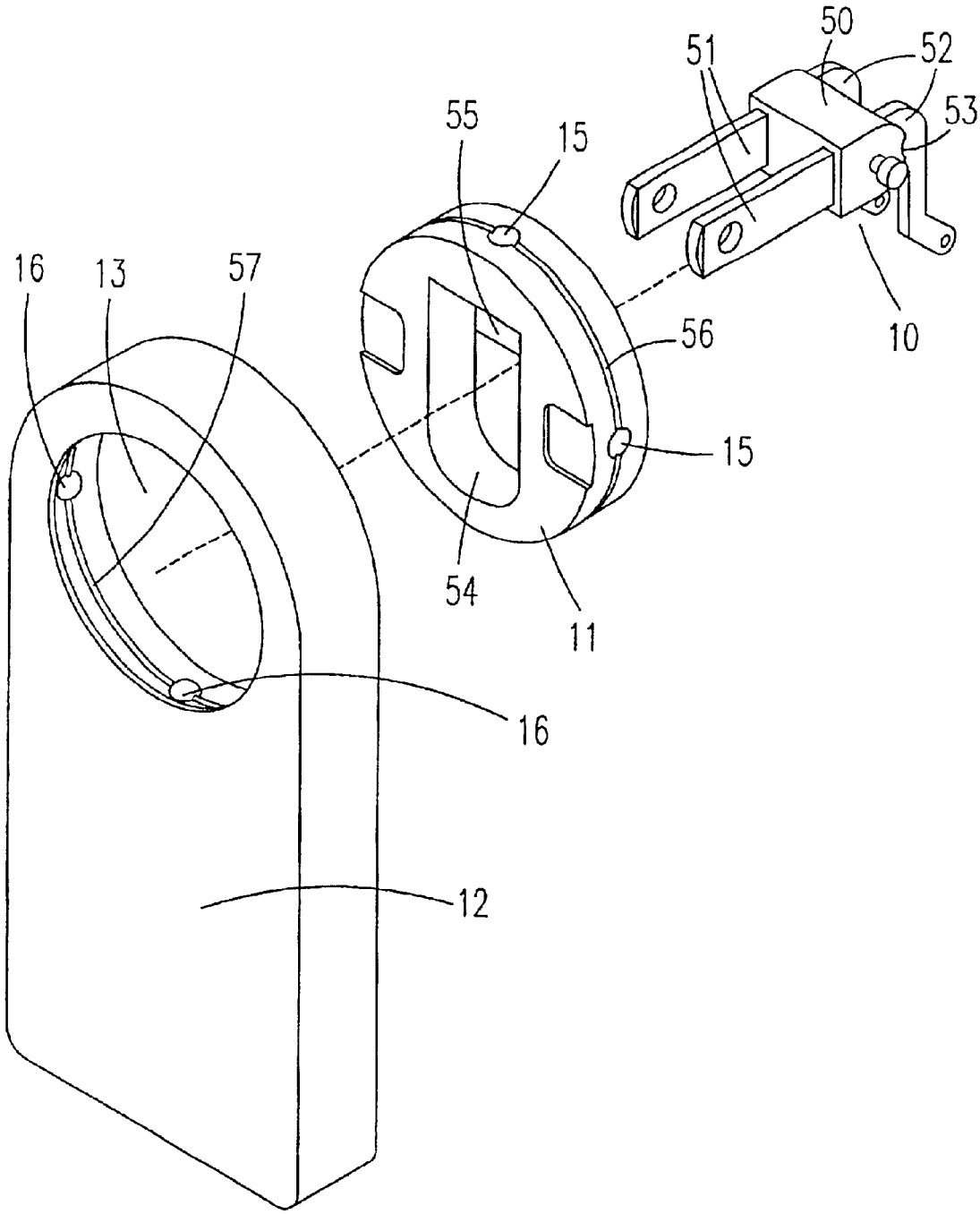
FIG. 5 is a three-dimensional decomposed diagram illustrating another preferred embodiment of a rotatable plug according to the present invention.
Figure 6A:
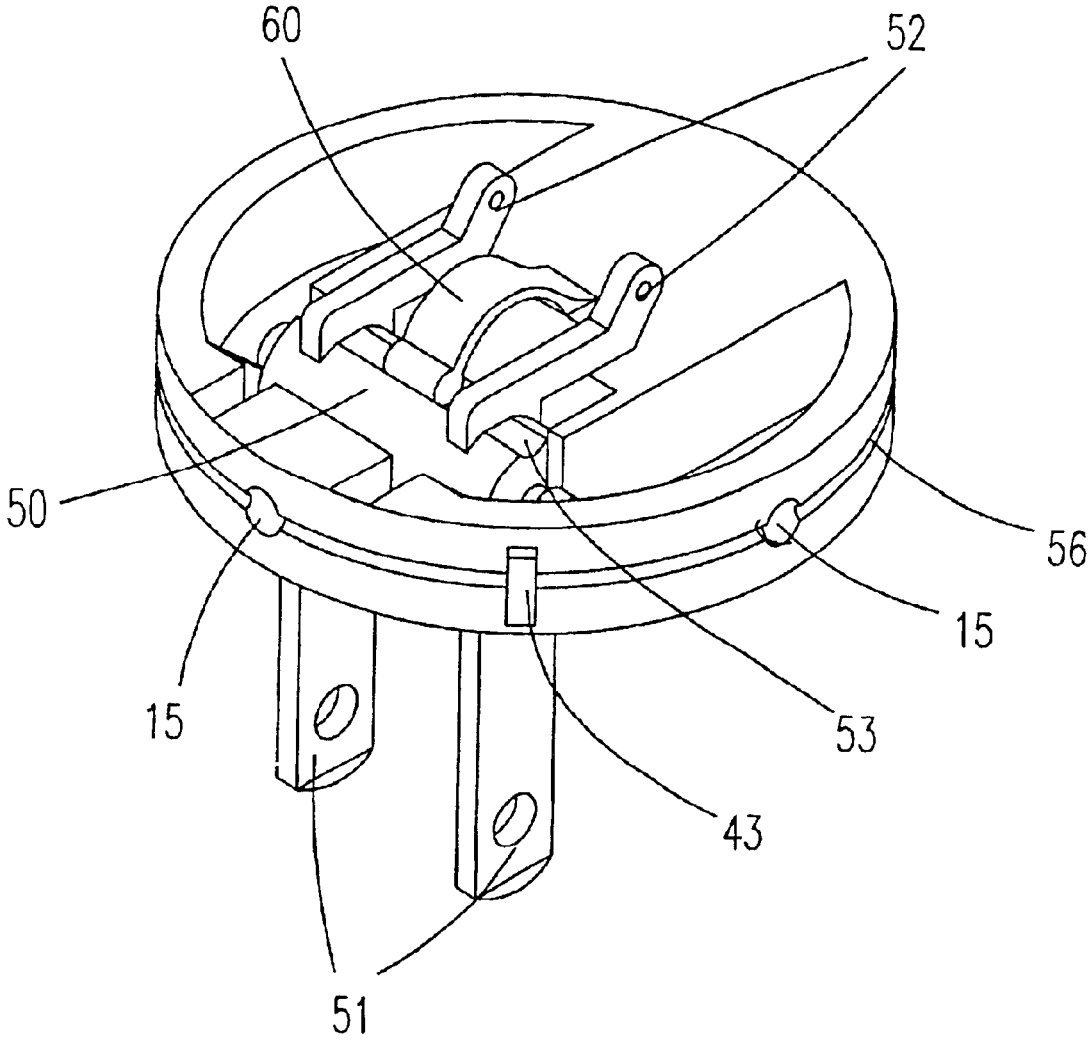
FIG. 6A is a diagram illustrating the back of a rotary case assembled with a plug of the rotatable plug in FIG. 5.

FIG. 5 is a three-dimensional decomposed diagram illustrating another preferred embodiment of a rotatable plug according to the present invention. As shown in FIG. 5, the rotary plug includes a plug 10, a rotary case 11 and a top cover 12. The structure and function of the rotatable plug are similar to the above embodiment except that the plug 10 is foldable and the connection method of the rotary case 11 to the top cover 12. Please refer to FIG. 5, the plug 10 includes a transverse rod 50, two blades 51 and two conductive terminals 52. The transverse rod 50 has a first groove 53 and a second groove thereon (not shown). Each blade 51 and each conductive terminal 52 are disposed at two opposite sides of the transverse rod 50 in a particular angle. The blade 51 and the conductive terminal 52 can be integrally formed. The two conductive terminals 52 are used for electrically connected to conductive wires (not shown) and the two blades 51 are used for plugging into an electronic receptacle. The transverse rod 50, the two blades 51 and the two conductive terminals 52 can be integrally formed. In addition, the transverse rod 50, the first groove 53 and the second groove can be integrally formed, too. Moreover, the rotary case 11 includes a concave storage base 54, an opening 55 and an elastic engaging element (not shown). The opening 55 is located at one end of the concave storage base 54 as shown in FIG. 5. FIG. 6A is a diagram illustrating the back of a rotary case assembled with a plug of the rotatable plug in FIG. 5. As shown in FIG. 6A, the elastic engaging element 60 has a first end fixed and connected to the back of the rotary case 11. When the plug 10 is disposed in the opening 55, the second end of the elastic engaging element 60 is engaged with the transverse rod 50 and is able to slide between the first groove and the second groove to allow the two blades 51 of the plug 10 to be received into the concave storage base 54.

Figure 6B:
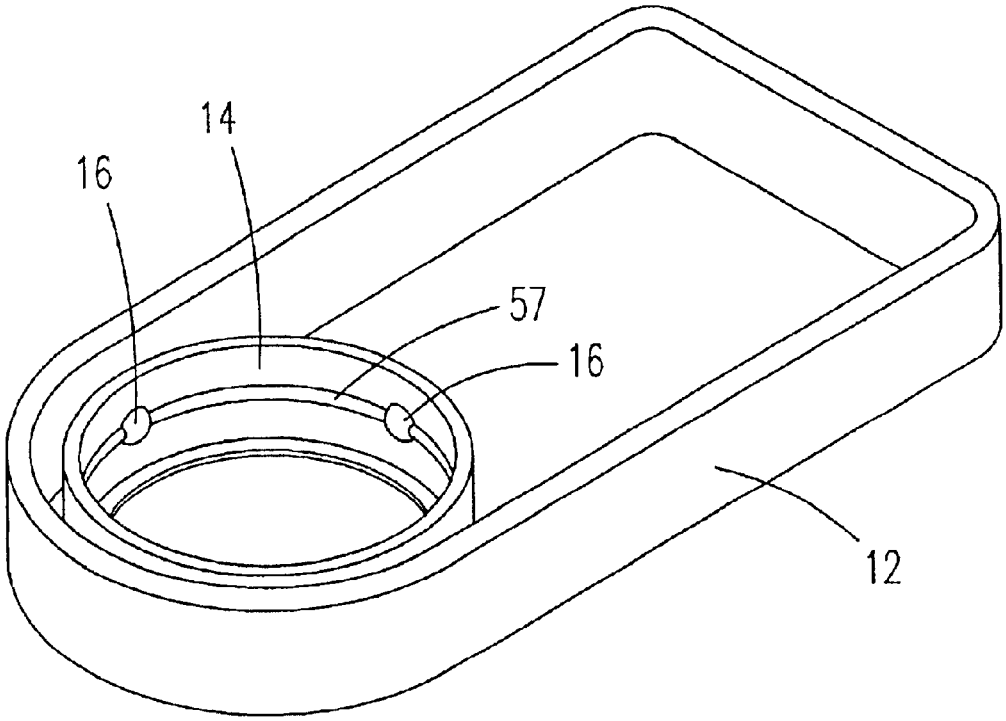
FIG. 6B is a diagram illustrating the back of a top cover of the rotatable plug in FIG. 5.

Please refer to FIGS. 5 and 6A, the rotary case 11 has an annular groove 56 and four position points, i.e. four concave points 15 (only two of them shown), on the circumferential surface. In addition, the circumferential surface of the rotary case 11 further includes a first protrusion 43 which is one unit of the restricting mechanism. FIG. 6B is a diagram illustrating the back of a top cover of the rotatable plug in FIG. 5. As shown in FIGS. 5 and 6B, the inside wall of the annular frame 14 of the top cover 12 has an annular protrusion 57 disposed at a relative position with the annular groove 56 of the rotary case 11. Furthermore, four elastic juts 16 also are disposed on the inside wall of the annular frame 14. In addition, the annular protrusion 57 can be replaced by a plurality of elastic protrusions.

Figure 6C:
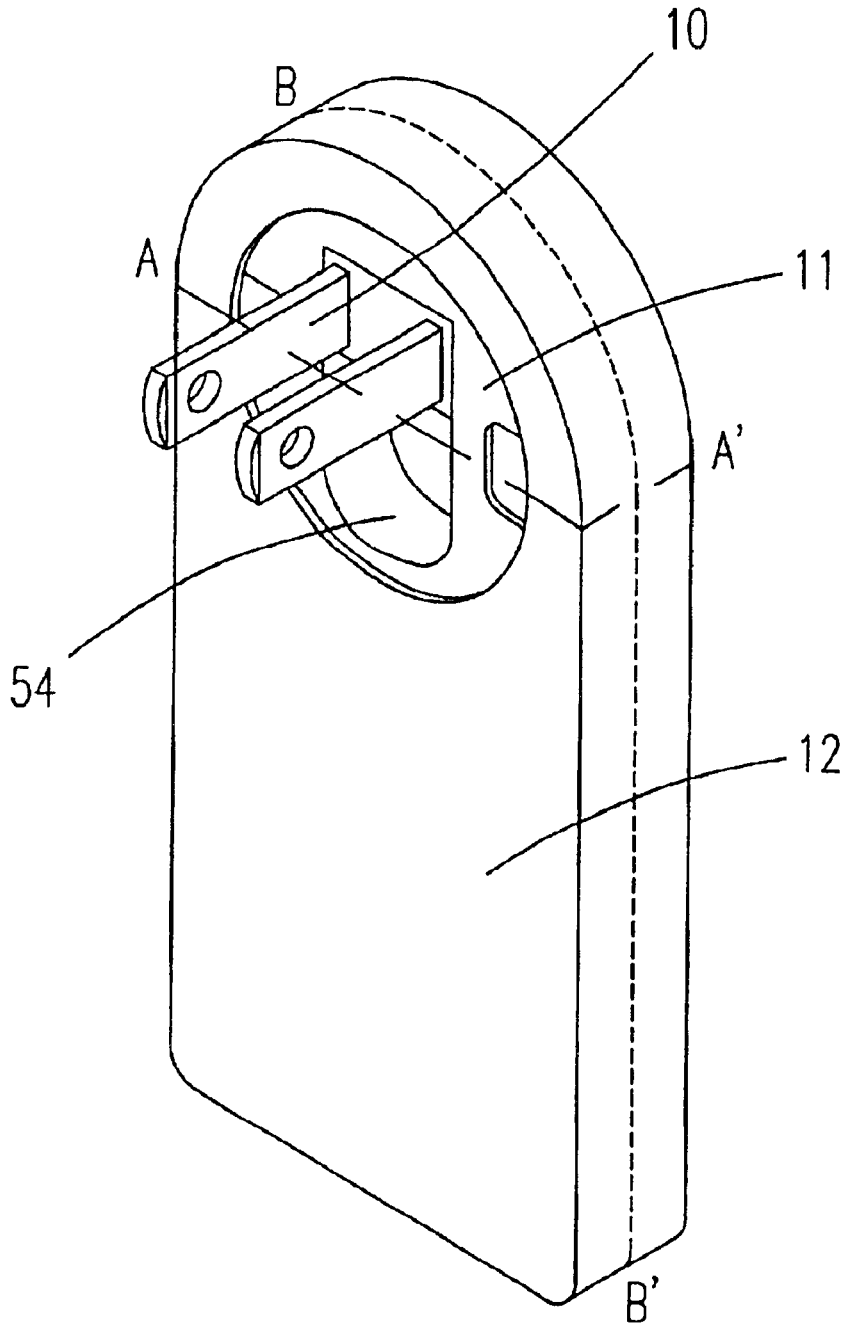
FIG. 6C is an assembly diagram illustrating the rotatable plug in FIG. 5.
Figure 7:
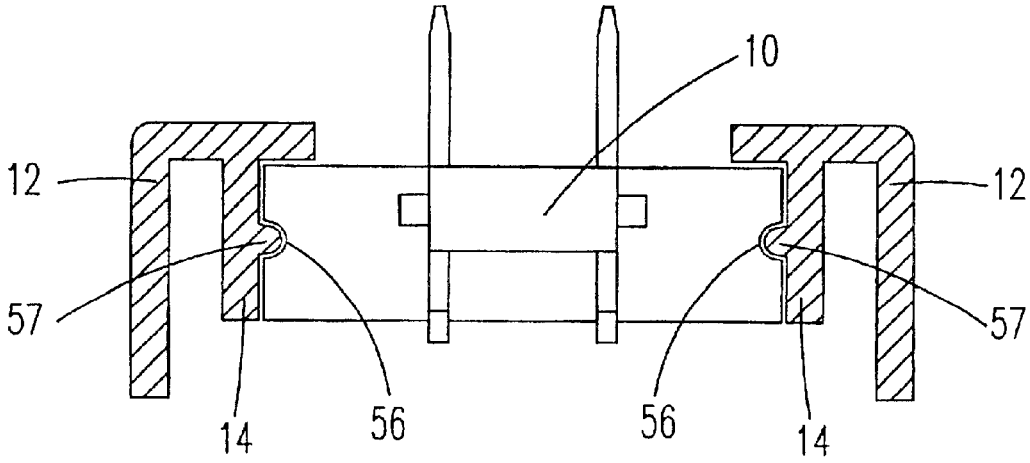
FIG. 7 is an A–A' line cross-sectional diagram illustrating the rotatable plug in FIG. 6C.

FIG. 6C is an assembly diagram illustrating the rotatable plug in FIG. 5. FIG. 7 is an A–A' line cross-sectional diagram illustrating the rotatable plug in FIG. 6C. As shown in FIG. 7, the annular protrusion 57 is engaged with the annular groove 56 of the rotary case 11, so the rotary case 11 can rotate in the annular frame 14 and not fall out.

Figure 8:
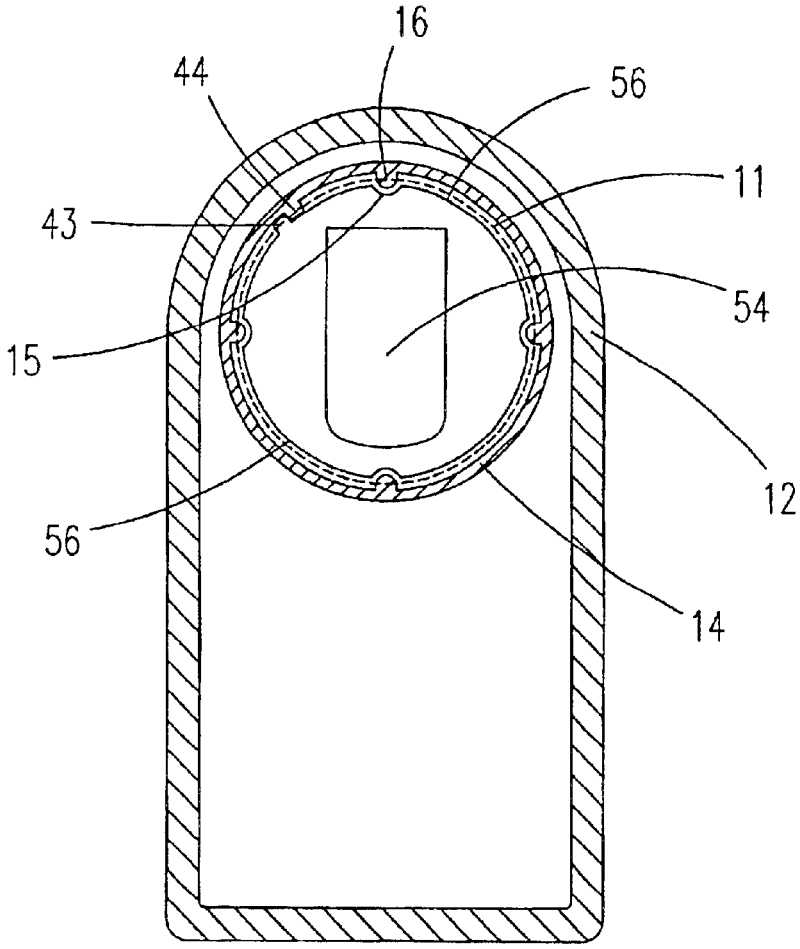
FIG. 8 is a B–B' line cross-sectional diagram illustrating the rotatable plug in FIG. 6C.
Figure 9A:
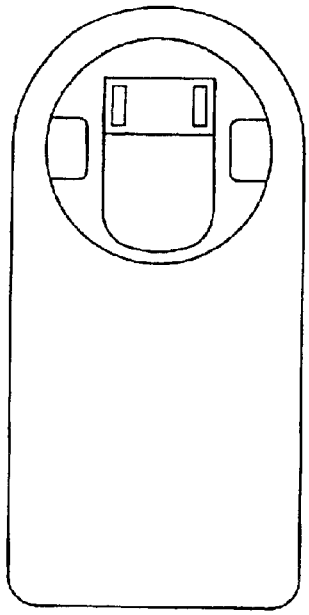
FIGS. 9A–9D are diagrams illustrating rotation conditions of the rotatable plug in FIG. 5.
Figure 9B:
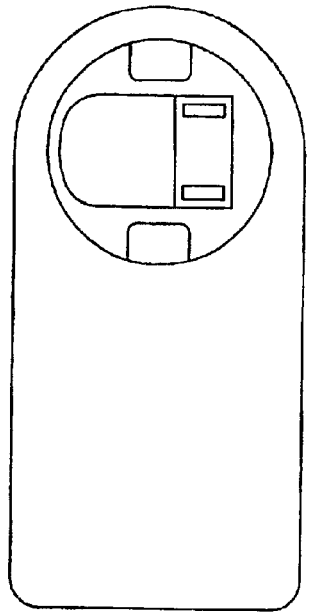
Figure 9C:
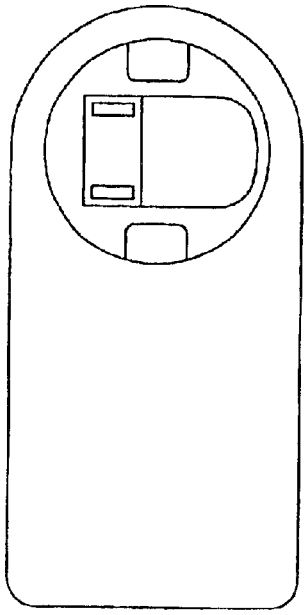
Figure 9D:
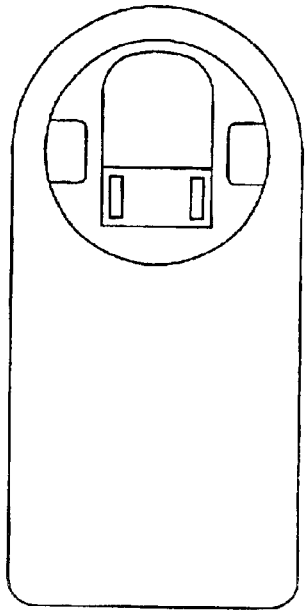

FIG. 8 is a B–B' line cross-sectional diagram illustrating the rotatable plug in FIG. 6C. As shown in FIG. 8, when the elastic juts 16 are engaged with the annular groove 56, the rotary case 11 can be connected with the top cover 12. The rotary case 11 includes four concave points 15 disposed on the circumferential surface or on the annular groove 56 and the first protrusion 43 disposed on the circumferential surface and between two concave points 15. At the same time, the annular frame 14 has four elastic juts 16 on the inside wall and at the corresponded position of the four concave points 15, respectively. Furthermore, the annular frame 14 also includes the second protrusion 44 on the inside wall and between two elastic juts 16. Thus, when the concave points 16 are respectively engaged with the elastic juts 16, the direction of the plug 10 can be positioned. Moreover, the structure and function of the first protrusion 43 and the second protrusion 44 in the restricting mechanism are similar to those of the aforementioned embodiment, so it is unnecessary to be redundantly described herein.

In addition, the top cover 12, the annular frame 14, the elastic juts 16, the annular protrusion 57 and the second protrusion 44 can be integrally formed. Also, the rotary case 11, the annular groove 56 and the concave points 15 and the first protrusion 43 can be integrally formed.

FIGS. 9A–9D are diagrams illustrating rotation conditions of the rotatable plug in FIG. 5. As shown in FIGS. 9A–9D, the direction and position of the plug can be changed according to the present invention. Therefore, the rotatable plug of the present invention can be applied in the adapter, the battery charger or the electronic equipment for adapting to different socket positions or different size spaces around the socket. Specially, the present invention also provides the rotatable plug with a foldable function. Because the blades of this rotatable plug are not located at the center of the rotary case, the direction and position of the blades can be more flexibly changed in response to the space limitation.

In sum, the rotatable plug according to the present invention has the following advantages:

The rotatable plug of the present invention can be directly connected to the conductive wire of the typical plug, so it does not require a special structure to cooperate with. In addition, the problems of bad conductive contact and unsafety caused by the prior art will be avoided.

2. According to the present invention, the top cover, the rotary case and the plug of the rotatable plug can be respectively integrally formed with their detail elements. Thus, the top cover, the rotary case and the plug can be easily and fast assembled to together by engaging.

3. The rotatable plug of the present invention employs the engagement of the position point and the position unit to achieve fast positioning. Furthermore, the number of the position point can be disposed according the practical requirement.

4. When the rotatable plug of the present invention is applied in a large size plug such as an adapter, it will not block the adjacent receptacles because the direction of the blades of the plug can be changed.

While the invention has been described in terms of what are presently considered to be the most practical and preferred embodiments, it is to be understood that the invention need not to be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A rotatable plug for connecting to an electronic receptacle, applied in a power supply apparatus, comprising:

a plug for plugging into said electronic receptacle and fixing and electronically connecting to at least two conductive wires, said plug being foldable;

a rotary case for disposing said plug, said rotary case having an annular groove surrounded a circumferential surface of said rotary case, said case being rotatable;

a top cover having a circle opening and an annular frame, wherein said circle opening has a diameter smaller than an inside diameter of said annular frame and said rotary case has a diameter smaller than said inside diameter of said annular frame, and said annular frame has a protruding element at a relative position of said annular groove for engaging to said annular groove and is disposed around said opening for accommodating said rotary case therein to rotate and said plug is carried out to rotate when said rotary case is rotated; and a restricting mechanism for limiting said rotary case to rotate in a particular rotating range, wherein said restricting mechanism has a first protrusion disposed on a circumferential surface of said rotary case and a second protrusion disposed on an inside wall of said annular frame, whereby when said rotary case rotates in a first direction till said first protrusion is against said second protrusion, a rotation of said rotary case in said first direction is limited.

2. The rotatable plug according to claim 1 wherein said power supply apparatus is one of adaptor and a battery charger.

3. The rotatable plug according to claim 1 wherein said top cover, said annular frame and said second protrusion are integrally formed.

4. The rotatable plug according to claim 1 wherein said rotary case and said first protrusion are integrally formed.

5. The rotatable plug according to claim 1 wherein said rotary case has a particular thickness and said annular frame further comprises a stopper for allowing said rotary case to rotate in said annular frame.

6. The rotatable plug according to claim 5 wherein said annular groove includes a plurality of position points for positioning a direction of said plug.

7. The rotatable plug according to claim 6 wherein each said position point is a concave point and each said position unit is an elastic jut, wherein said elastic juts have a relative position with said concave points for engaging with said elastic juts respectively.

8. The rotatable plug according to claim 1 wherein said plug is one of a fixed plug and a foldable plug.

9. The rotatable plug according to claim 8 wherein said foldable plug comprises:

a transverse rod having a first and a second grooves and having two ends for pivotally connected to said rotary case;

at least two blades for plugging into said electronic receptacle; and at least two conductive terminals fixed and electronically connected to said at least two conductive wires respectively, wherein each said blade and each said conductive terminal are disposed at two opposite sides of said transverse rod to form a particular angle.

10. The rotatable plug according to claim 9 wherein each said blade amd each said conductive terminal are integrally formed.

11. The rotatable plug according to claim 9 wherein said transverse rod, said first groove and said second groove are integrally formed.

12. The rotatable plug according to claim 9 wherein said rotary case includes a concave storage base on a front surface having an opening disposed at one end of said concave storage base for disposing said plug therein and used for receiving said at least two blades therein when said plug is folded; and an elastic engaging element having a first end fixed and connected to a back of said rotary case and a second end for engaging said transverse rod of said plug to slide between said first and second grooves of said transverse rod.

13. The rotatable plug according to claim 12 wherein said rotary case, said concave storage base, said elastic engaging element and said opening are integrally formed.

14. The rotatable plug according to claim 1 wherein said protruding element is an annular protrusion.

15. The rotatable plug according to claim 14 wherein said annular groove includes a plurality of position points and said annular protrusion includes a plurality of position units for engaging with said plural position points for positioning a direction of said plug.

16. The rotatable plug according to claim 15 wherein each said position point is a concave point and each said position unit is an elastic jut, wherein said elastic juts have a relative position with said concave points for engaging with said elastic juts respectively.

17. The rotatable plug according to claim 16 wherein said first protrusion is disposed between two said position points; and said second protrusion is disposed between said two elastic juts, whereby when said rotary case rotates in a first direction till said first protrusion is against said second protrusion, a rotation of said rotary case in said first direction is limited.

18. The rotatable plug according to claim 17 wherein said top cover, said annular frame, said protruding element and said second protrusion are integrally formed.

19. The rotatable plug according to claim 17 wherein said rotary case, said annular groove, said plural concave points and said first protrusion are integrally formed.

* * * * *